United States Patent [19]

Jones

[11] Patent Number: 4,869,305

[45] Date of Patent: Sep. 26, 1989

[54] DOORKNOB ANTI-ROTATION DEVICE

[76] Inventor: Mark T. Jones, 3046 Enisglen Dr., Palm Harbor, Fla. 34683

[21] Appl. No.: 284,163

[22] Filed: Dec. 14, 1988

[51] Int. Cl.[4] ..... B65D 65/02

[52] U.S. Cl. ..... 150/155; 292/DIG. 2

[58] Field of Search ..... 150/155; 292/347, DIG. 2; 16/DIG. 2, DIG. 30, DIG. 12

[56] References Cited

U.S. PATENT DOCUMENTS

| | | | |
|---|---|---|---|
| 1,633,988 | 6/1927 | Jones | 292/DIG. 2 |
| 2,557,517 | 6/1951 | Scruggs | 383/76 |
| 2,587,285 | 2/1952 | Broscoe | 292/347 |
| 2,610,877 | 9/1952 | Weaver | 292/DIG. 2 |
| 2,781,220 | 2/1957 | Zietlow | 292/DIG. 2 |
| 3,174,788 | 3/1965 | Williams | 292/347 |
| 3,556,571 | 1/1971 | Laub, Jr. | 292/DIG. 2 |
| 4,007,956 | 2/1977 | Harris et al. | 292/347 |
| 4,069,692 | 1/1978 | Hemphill | 292/DIG. 2 |
| 4,471,980 | 9/1984 | Hickman | 292/19 |

*Primary Examiner*—William Price

*Attorney, Agent, or Firm*—Joseph C. Mason, Jr.; Ronald E. Smith

[57] ABSTRACT

A doorknob cover that defeats facile rotation of a doorknob. Two layers of cloth or other low friction material are placed in juxtaposition with one another and joined at their respective outermost peripheral edges. A second attachment is made between the materials just radially inwardly of the outermost peripheral edge to form a toroidal cavity to receive a drawstring. The device is placed over a doorknob and the opposite ends of the drawstrings are tied together tightly so that the device cannot be removed from the doorknob unless the knot is first untied. Young children are unable to rotate a doorknob covered by the device due to the double layer of cloth and the low frictional engagement between the inner piece of cloth and the doorknob.

11 Claims, 2 Drawing Sheets

FIG. 3
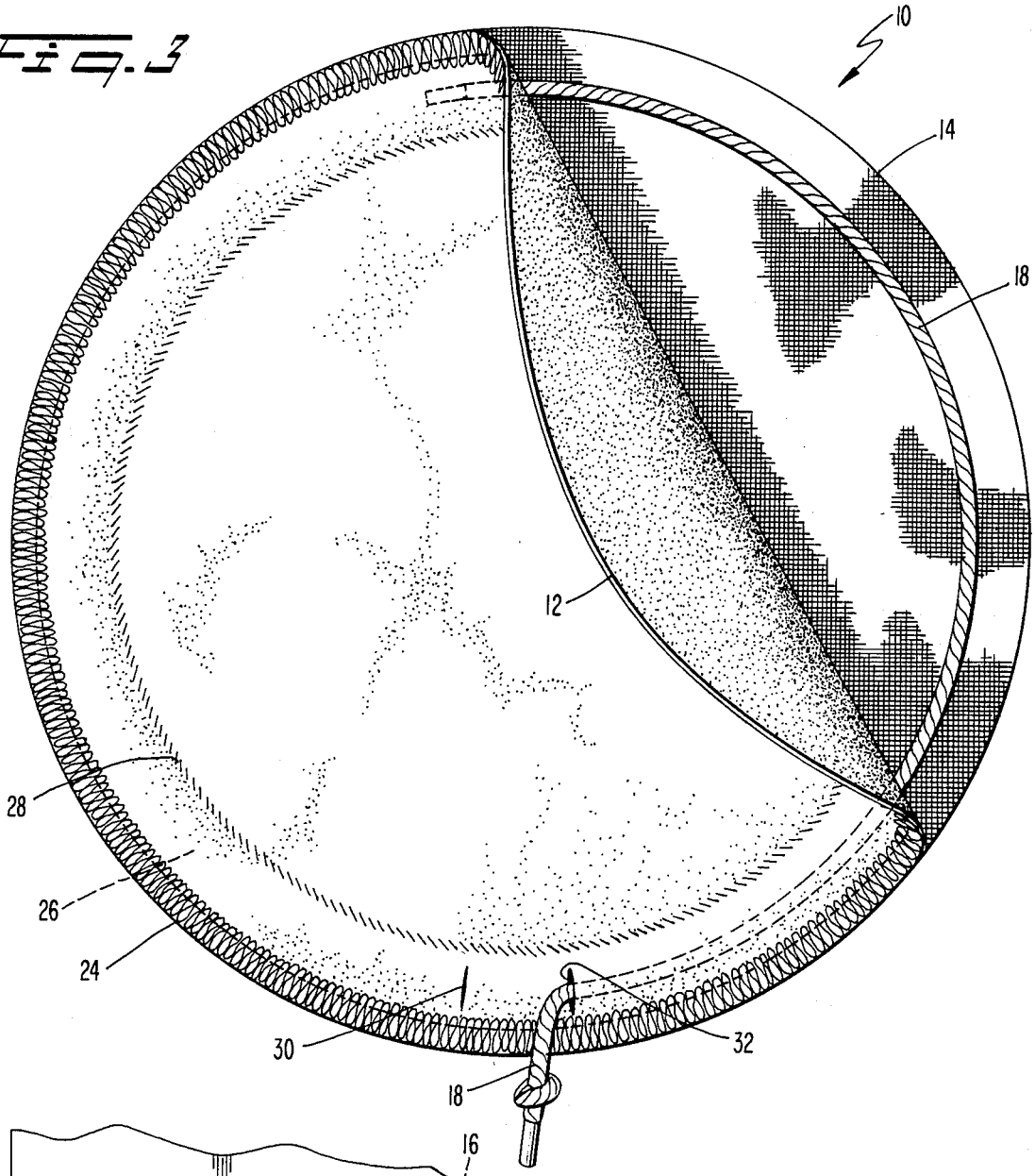
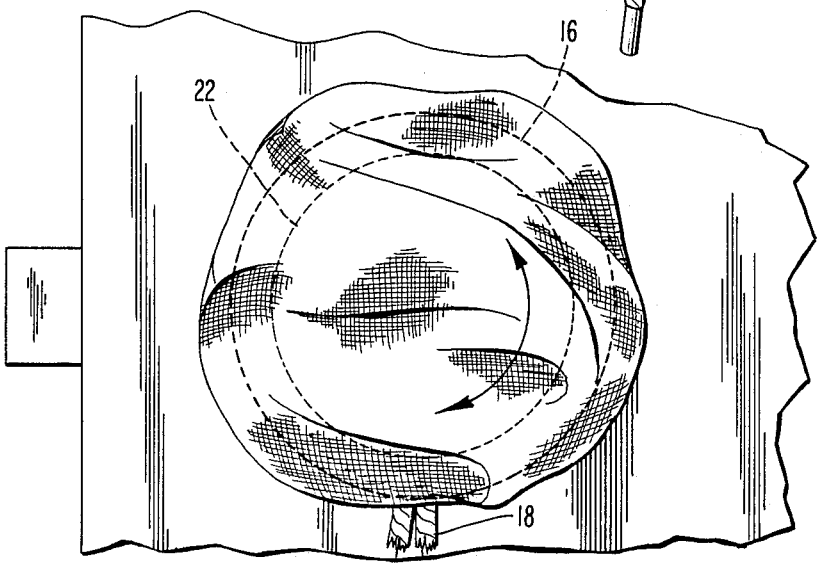
FIG. 4

DOORKNOB ANTI-ROTATION DEVICE

TECHNICAL FIELD

This invention relates, generally, to devices that make it difficult for young children to open doors. More specifically, it relates to a cloth device that fits over a doorknob and which slips relative to the doorknob when grasped by a young child.

BACKGROUND ART

Children learn at a very early age that open doors lead either to unexplored rooms or the great outdoors. As soon as they observe an adult opening a door by manipulation of a doorknob, they attempt to do the same.

Very short children have even been observed to move a chair to a door, climb the chair and successfully open the door.

As a result of their urge to open doors and explore the spaces beyond, young children have wandered into busy streets, fallen down stairways and suffered other misfortunes a closed but unlocked door was intended to protect.

Inventors aware of the problem have developed several devices intended to prevent the facile turning of doorknobs by young children. For example, U.S. Pat. No. 2,781,220 to Zietlow discloses a mesh material forming a tubular length that is gathered by a drawstring that retains the material in position over a doorknob. U.S. Pat. No. 1,633,988 to Jones provides a doorknob cover made from a flexible, fabric material. U.S. Pat. No. 2,557,517 to Scruggs discloses a woven bag web having a draw cord. A plastic doorknob cover is shown in U.S. Pat. No. 2,587,285 to Broscoe. Other U.S. patents of interest include U.S. Pat. Nos. 2,610,877; 3,174,788; 4,007,956; 4,069,692 and 4,471,980.

All of the above devices make it at least slightly more difficult for children to turn doorknobs, but field tests have shown that even the best of them are routinely defeated, even by very young children.

There exists a clear need for an improved doorknob cover, but the prior art neither teaches nor suggests how a superior device could be provided.

DISCLOSURE OF INVENTION

The present invention is a doorknob cover made by at least two layers of cloth or other material that exhibits a very low degree of friction when disposed in frictional engagement to a doorknob.

The two layers of material are placed in registration with one another so that an outer layer of cloth material overlies an inner layer. The preferred original shape of each piece of cloth is circular; the two pieces are sewed together in two circular stitches. The first stitch is at the periphery of the pieces of cloth and the second circular stitch is positioned just radially inwardly therefrom. Accordingly, a generally toroidal cavity is formed between the two stitches; a drawstring of conventional construction occupies the cavity and the opposite ends of the drawstring protrude from a slot formed in the inner or doorknob-contacting cloth member.

The device is placed over a doorknob, the rotation of which by a child is undesired, and the drawstring is pulled until the device is closely wrapped about the stem portion of the doorknob. The drawstring is then tied with a knot of the type that cannot be untied by most children and the installation of the device is complete.

It is therefore understood that a general object of this invention is to equip adults with a tool that they can employ with a minimum amount of effort in a very short time to help child-proof the doorknobs of a building.

A more specific objective is to provide a device that is quickly and easily secured to a doorknob by an adult and not easily removed therefrom by a child.

Another specific object of this invention is to advance the art of doorknob opening-prevention devices by providing a tool that is extremely inexpensive so that it will be economical to manufacture and, thus, affordable in quantity by virtually all consumers.

The invention accordingly comprises the features of construction, combination of elements and arrangement of parts that will be exemplified in the descriptions set forth hereinafter and the scope of the invention will be set forth in the claims.

BRIEF DESCRIPTION OF DRAWINGS

For a fuller understanding of the nature and objects of the invention, reference should be made to the following detailed description, taken in connection with the accompanying drawings, in which:

FIG. 3 is a bottom plan view of the device with the inner cloth layer pulled away to clarify the structure of the device; and FIG. 4 is a front elevational view of the device.

BEST MODES FOR CARRYING OUT THE INVENTION

Figure 1:
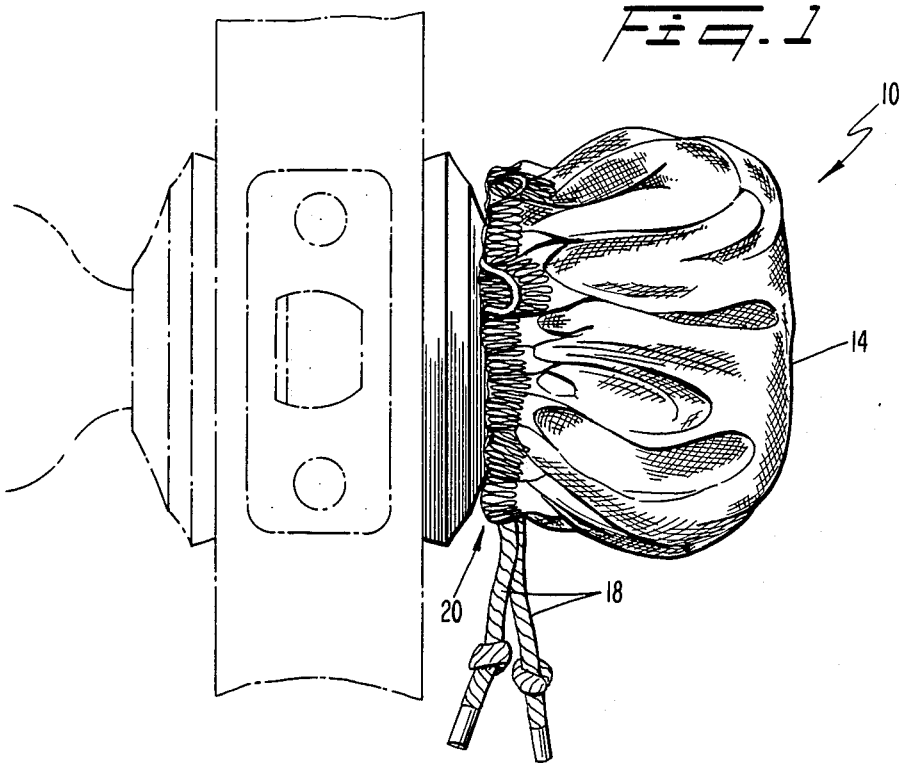
FIG. 1 is a side view of the novel device disposed in its operative configuration relative to a doorknob.

Referring now to FIG. 1, it will there be seen that an illustrative embodiment of the invention is designated by the reference numeral 10 as a whole.

Device 10 includes a first piece of flexible material 12 (FIG. 2) which can be of virtually any predetermined geometrical configuration but which in the preferred embodiment of this invention is of generally circular configuration. Material 12 may be formed of any material that exhibits very low friction when rubbed against a doorknob; 100% acrylic is the preferred material. Cotton and various cotton/polyester blends have also been found suitable and effective.

Figure 2:
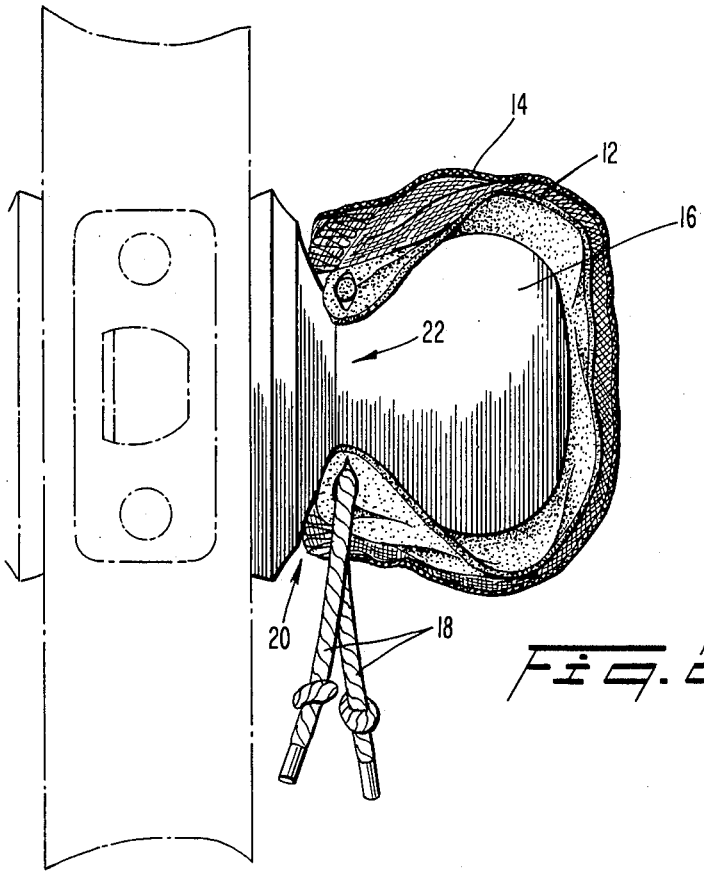
FIG. 2 is a cutaway view of the device.

A second piece of acrylic, cloth or blended material 14 which generally conforms to the configuration of inner piece 12 overlies said inner piece 12 as shown in FIG. 2 when the invention 10 is assembled; it has the same general dimension as inner piece 12 but may be of slightly larger dimension since it must extend over a slightly larger expanse when device 10 is disposed in its operative relation to a doorknob as perhaps best understood in connection with FIGS. 1 and 2.

Device 10, known commercially as the Doorknobbie TM, is secured to doorknob 16 by means of a drawstring 18; drawstring 18 is tightly knotted as at 20 by an adult in order to defeat facile removal of the device from the doorknob. When correctly installed, drawstring 18 will tightly circumscribe the stem portion 22 of doorknob 16.

The construction of device 10 is perhaps best understood in connection with FIG. 3.

Inner cloth 12 and outer cloth 14 are first placed in registration with one another and sewed or otherwise fixedly secured together by any suitable means at their respective outermost peripheries as at 24.

A space, toroidal cavity or passageway 26 to accommodate drawstring 18 is formed by sewing or otherwise securing the two pieces of material together just radially inwardly of their common periphery as at 28. Drawstring 18 does not fully circumscribe device 10 when the cloth is laid flat as shown in FIG. 3 but its opposite ends do protrude through slots 30, 32 formed in inner cloth 12 when the device is formed into its doorknob-conforming shape.

Tests of the novel doorknob cover member 10 have shown that it fully performs its intended function whereas single-layered cloth doorknob covers, or plastic doorknob covers do not.

INDUSTRIAL APPLICABILITY

Doorknobs and young children are ubiquitous. Thus, the present invention will be used in households and child care centers of all types. If the inner cloth 12 is made of a "shammy" or goatskin material, such as the type used with car polish, the device cannot even be defeated by adults. Thus, it also has utility in mental hospital environments or other places where strong-gripped adult individuals are to be deterred from opening certain doors.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A device that defeats facile rotation of a doorknob, comprising:

a first piece of flexible material having cloth-like properties;

said first piece of material having a predetermined geometrical configuration and having a predetermined size sufficient to overlie the front, sides and back of a doorknob when wrapped thereabout;

a second piece of flexible material having cloth-like properties;

said second piece of material having generally the same geometrical configuration and size of said first piece of material;

said second piece of material being disposed in overlying relation to said first piece of material so that the respective outermost peripheral edges of said first and second pieces of material are in registration with one another when said first and second pieces of material are generally conformed to the shape of a doorknob;

first closure means joining the respective outermost peripheral edges of said first and second pieces of material to one another;

second closure means, spaced radially inwardly from said first closure means, joining said first and second pieces of material to one another;

a passageway means being formed between and defined by said first and second closure means;

an opening formed in said passageway means;

an elongate drawstring means received within said passageway means;

opposite ends of said drawstring means protruding through said opening;

a doorknob-receiving cavity means defined by said first piece of material when said first and second pieces of material are wrapped around a doorknob, said cavity means generally conforming to the configuration and size of a doorknob; and said cavity means having a mouth portion the size of which is made smaller when said drawstring means opposite ends are pulled;

whereby said device is secured to a doorknob by enlarging the size of said mouth portion of said cavity means so that said cavity means receives said doorknob, reducing the size of the mouth portion of said cavity means by pulling the opposite ends of said drawstring means until said mouth portion substantially closes around a stem portion of said doorknob, and tying a knot to secure the opposite ends of said drawstring means to one another so that a child cannot separate the device from the doorknob.

2. The device of claim wherein said material has a very low degree of friction when disposed in frictional engagement with a doorknob.

3. The device of claim 2, wherein the predetermined configuration of said first and second pieces of material is generally circular.

4. The device of claim 3, wherein said first and second closure means are sewed stitches formed by thread.

5. The device of claim 2, wherein said first and second pieces of material are formed of cloth.

6. The device of claim 2, wherein said second piece of material is slightly larger in diameter than said first piece of material.

7. The device of claim 2, wherein said first and second pieces of material are formed of acrylic.

8. The device of claim 2, wherein said first and second pieces of material are formed of goatskin.

9. The device of claim 2, wherein said first and second pieces of material are formed of a shammy material.

10. The device of claim 2, wherein said first and second piece of material are formed of cotton.

11. The device of claim 2, wherein said first and second pieces of material are formed of a cotton/polyester blend.

* * * * *